US008489003B2

(12) United States Patent
Ebe

(10) Patent No.: US 8,489,003 B2
(45) Date of Patent: Jul. 16, 2013

(54) DEVELOPING DEVICE AND IMAGE FORMING APPARATUS

(75) Inventor: Takaaki Ebe, Tokyo (JP)

(73) Assignee: Oki Data Corporation, Tokyo (JP)

( * ) Notice: Subject to any disclaimer, the term of this patent is extended or adjusted under 35 U.S.C. 154(b) by 239 days.

(21) Appl. No.: 12/926,703

(22) Filed: Dec. 6, 2010

(65) Prior Publication Data

US 2011/0135344 A1 Jun. 9, 2011

(30) Foreign Application Priority Data

Dec. 9, 2009 (JP) ..... 2009-279406

(51) Int. Cl.
*G03G 15/08* (2006.01)

(52) U.S. Cl.
USPC ..... 399/281; 399/284

(58) Field of Classification Search
USPC ..... 399/281, 284
See application file for complete search history.

(56) References Cited

U.S. PATENT DOCUMENTS 5,132,734 A * 7/1992 Momiyama et al. ..... 399/281
6,229,980 B1 * 5/2001 Ogawa et al. ..... 399/283
6,321,057 B1 * 11/2001 Yamamoto ..... 399/281
6,381,434 B1 * 4/2002 Yamamoto ..... 399/266
2009/0257791 A1 * 10/2009 Nakagawa et al. ..... 399/287

FOREIGN PATENT DOCUMENTS

JP 2000-258987 A 9/2000

* cited by examiner

*Primary Examiner* — Walter L Lindsay, Jr.
*Assistant Examiner* — Benjamin Schmitt
(74) *Attorney, Agent, or Firm* — Rabin & Berdo, P.C.

(57) ABSTRACT

A developing device includes a developer bearing body that rotates in a first direction, and a supply brush roller, out of contact with the body, that also rotates in the first direction. A brush contact member has a first contact portion in contact with bristles of the roller above a first horizontal plane passing through a rotational axis of the roller and upstream in the first rotational direction of the roller of a portion of the roller opposing the body. A thickness adjusting member has a second contact portion in contact with the body below a second horizontal plane passing through a rotational axis of the body and downstream in the first rotational direction of the body of the portion of the roller opposing the body. A first vertical plane passing through the first contact portion is closer to the axis of the roller than is a second vertical plane passing through the second contact portion.

10 Claims, 14 Drawing Sheets

FIG. 10

| | NO PRINT WITH NO IMAGE | AFTER 100 PRINTS WITH NO IMAGE | AFTER 300 PRINTS WITH NO IMAGE | AFTER 500 PRINTS WITH NO IMAGE | AFTER 1,000 PRINTS WITH NO IMAGE | AFTER 10,000 PRINTS WITH NO IMAGE |
|---|---|---|---|---|---|---|
| FIRST EMBODIMENT | ○ | ○ | ○ | ○ | ○ | ○ |
| FIRST COMPARATIVE EXAMPLE | ○ | × | × | × | × | × |
| SECOND COMPARATIVE EXAMPLE | × | | | | | |

FIG. 14

| | NO PRINT WITH NO IMAGE | AFTER 100 PRINTS WITH NO IMAGE | AFTER 300 PRINTS WITH NO IMAGE | AFTER 500 PRINTS WITH NO IMAGE | AFTER 1,000 PRINTS WITH NO IMAGE | AFTER 10,000 PRINTS WITH NO IMAGE |
|---|---|---|---|---|---|---|
| SECOND EMBODIMENT | ○ | ○ | ○ | ○ | ○ | ○ |

DEVELOPING DEVICE AND IMAGE FORMING APPARATUS

CROSS-REFERENCE TO RELATED APPLICATION

This application claims priority under 35 U.S.C. §119 of prior Japanese Patent Application No. P 2009-279406 filed on Dec. 9, 2009, the entire contents of which are incorporated herein by reference.

BACKGROUND OF THE INVENTION

1. Field of the Invention

This application relates to a developing device and an image forming apparatus including the device.

2. Description of the Related Art

A developing device includes a developing roller and a brush roller. The developing roller develops an electrostatic latent image on a photosensitive drum with toner. The brush roller, which has bristles made of fiber on its surface, supplies the toner to the developing roller. Japanese Laid-Open Patent No. 2000-258987 discloses one such developing device.

In the aforementioned developing device, however, the toner is trapped between the bristles of the brush roller by contact between the developing roller and the brush roller, resulting in a loss of elasticity of the bristles. This will cause a lack of stability of supply of the toner to the developing roller.

SUMMARY OF THE INVENTION

An object of the application is to disclose a developing device and an image forming apparatus, capable of providing a steady and reliable supply of toner from a brush roller to a developing roller.

According to one aspect, a developing device includes a developer bearing body, a supply brush roller, a brush contact member and a thickness adjusting member. The body rotates in a first direction. The roller is disposed below the body in opposition to and out of contact with the body, and rotates in the first direction. The roller has bristles supplying a developer to the body. The contact member has a first contact portion in contact with the bristles. The first contact portion lies above a first horizontal plane passing through a rotational axis of the roller, and upstream in the first rotational direction of the roller, of a portion of the roller opposing the body. The adjusting member has a second contact portion in contact with the body so as to adjust a thickness of a layer of the developer on the body to a predetermined thickness. The second contact portion lies below a second horizontal plane passing through a rotational axis of the body, and downstream in the first rotational direction of the body, of the portion of the roller opposing the body. In addition, a first vertical plane passing through the first contact portion is closer to the rotational axis of the roller than is a second vertical plane passing through the second contact portion.

According to another aspect, an image forming apparatus includes the developing device.

The full scope of applicability of the developing device and the image forming apparatus will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The developing device and the image forming apparatus will be more fully understood from the following detailed description with reference to the accompanying drawings, which are given by way of illustration only, and should not limit the invention, wherein:

FIG. 10 is a table showing results of an evaluation test of the first embodiment;

FIG. 14 is a table showing results of an evaluation test of the second embodiment.

DETAILED DESCRIPTION OF THE INVENTION

Preferred embodiments of a developing device and an image forming apparatus according to the invention will be described in detail with reference to the accompanying drawings. In each embodiment, the description will be given with an image-forming unit and a printer respectively as the developing device and the image forming apparatus.

First Embodiment

Figure 1:
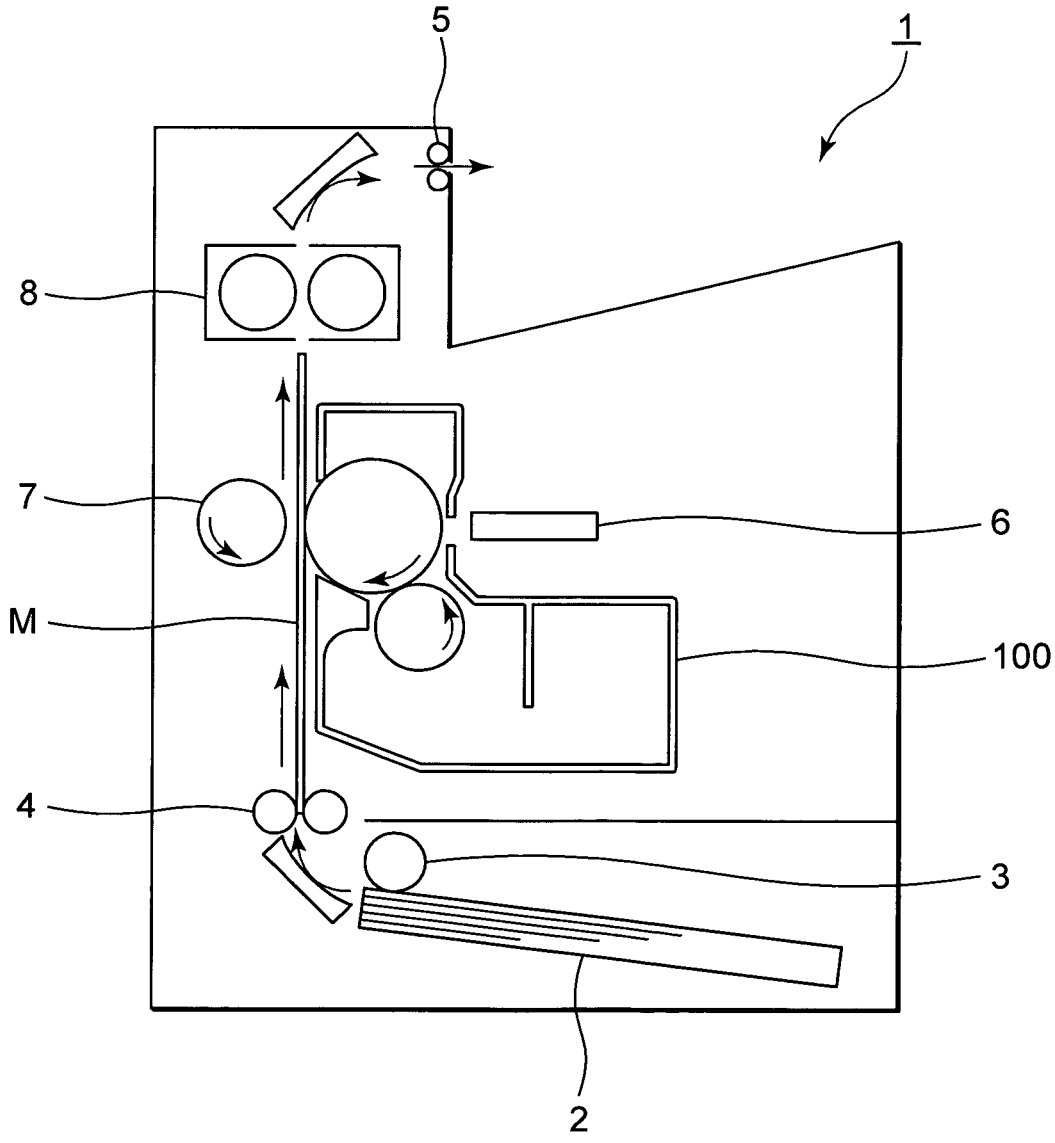
FIG. 1 is a cross-sectional view of a printer of a first embodiment.

FIG. 1 is a cross-sectional view of a printer 1 of a first embodiment, which may include a medium tray 2, transport rollers 3, 4 and 5, an LED (Light-Emitting Diode) head 6, an image-forming unit 100, a transfer roller 7 and a fixing unit 8.

The medium tray 2 accommodates a stack of media M. The transport rollers 3, 4 and 5 transport the medium in the printer. The LED head 6 exposes a surface of a photosensitive drum 101 (described later) to light, so as to form an electrostatic latent image on the surface. The image-forming unit 100 develops the latent image with toner, thereby forming a toner image on the drum. The transfer roller 7 transfers the toner image to the medium. The fixing unit 8 fixes the toner image onto the medium.

Figure 2:
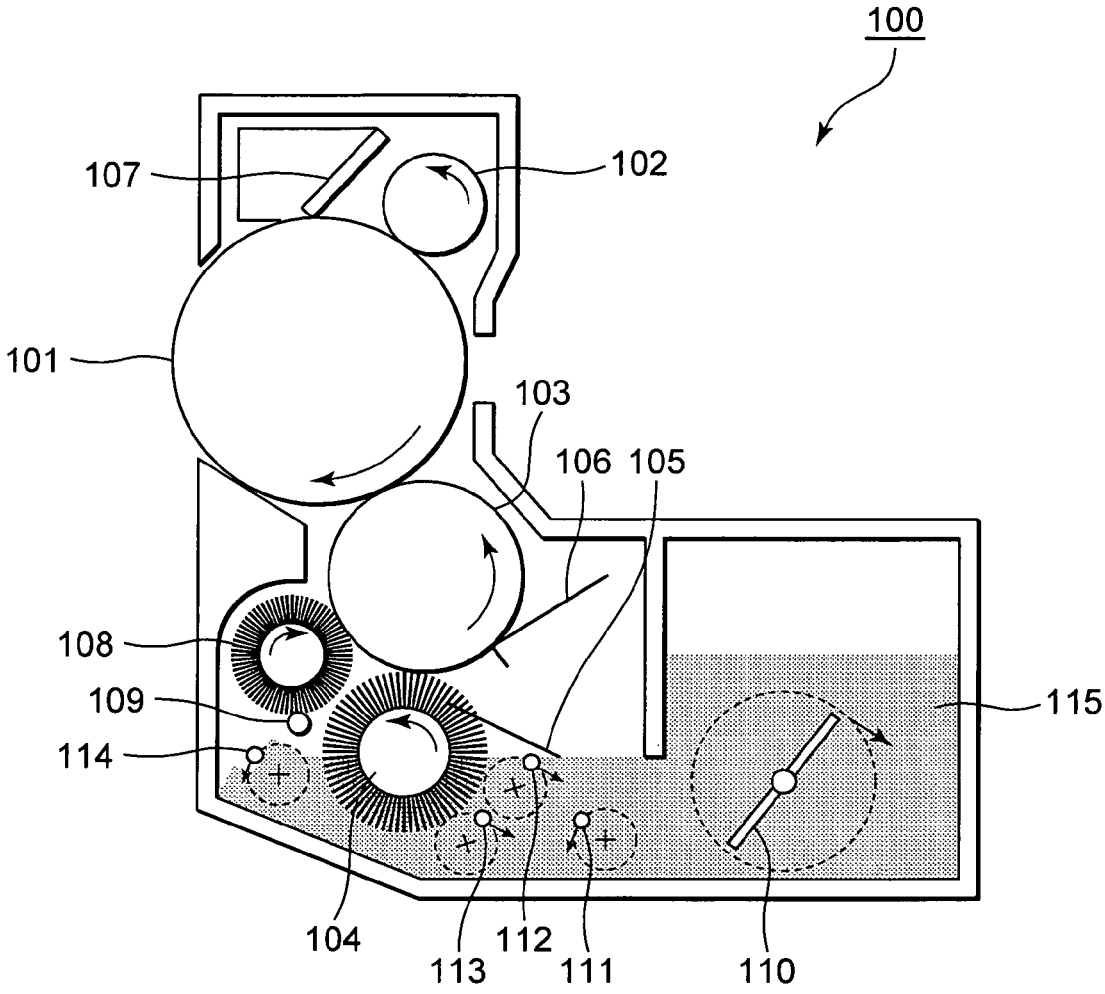
FIG. 2 is a cross-sectional view of an image-forming unit of the first embodiment.

Next, the image-forming unit 100 will be described. FIG. 2 is a cross-sectional view of the image-forming unit 100, which may include the photosensitive drum 101, a charging roller 102, a developing roller 103, a supply brush roller 104, a brush blade 105, a developing blade 106, a cleaning blade 107, a collection brush roller 108, a flicker 109, and agitators 110, 111, 112, 113 and 114.

The photosensitive drum 101 as an image bearing body bears the electrostatic latent image on its surface. The charging roller 102 charges the surface of the drum. The developing roller 103 as a developer bearing body opposes the drum and develops the latent image with nonmagnetic one-component toner 115 as a developer. The supply brush roller 104, which has bristles made of fiber on its surface, uses the elasticity of the bristles to supply the toner 115 to the developing roller. The supply brush roller is disposed below the developing roller in opposition to and out of contact with the developing roller. The brush blade 105 as a brush contact member is in contact with the bristles of the supply brush roller and causes the supply brush roller to throw the toner 115 on the bristles toward the developing roller.

The developing blade 106 as a thickness adjusting member, which is pressed toward developing roller 103, adjusts the thickness of a layer of the toner 115 to a predetermined thickness. The cleaning blade 107 scrapes toner that remains on the photosensitive drum 101 after the toner image has been transferred to the medium, off the drum. The collection brush roller 108 collects toner that remains on the developing roller after the electrostatic latent image has been developed, from the developing roller. The flicker 109 flicks the toner off the collection brush roller. The agitators 110, 111, 112, 113 and 114 agitate the toner 115 in the image-forming unit 100.

The photosensitive drum 101, the charging roller 102, the developing roller 103, the supply brush roller 104, the collection brush roller 108 and the agitator 110 respectively rotate in the directions shown in FIG. 2. Each of the agitators 111, 112, 113 and 114, which is a cranked bar made of metal, rotates along a circle shown by a dashed line in FIG. 2. The agitators 111, 112 and 113 deliver the toner 115 to a contact portion of the brush blade 105 in contact with the supply brush roller. The agitator 114, which is disposed below the collection brush roller, conveys the toner flicked off the collection brush roller by the flicker 109 toward the supply brush roller.

Figure 3:
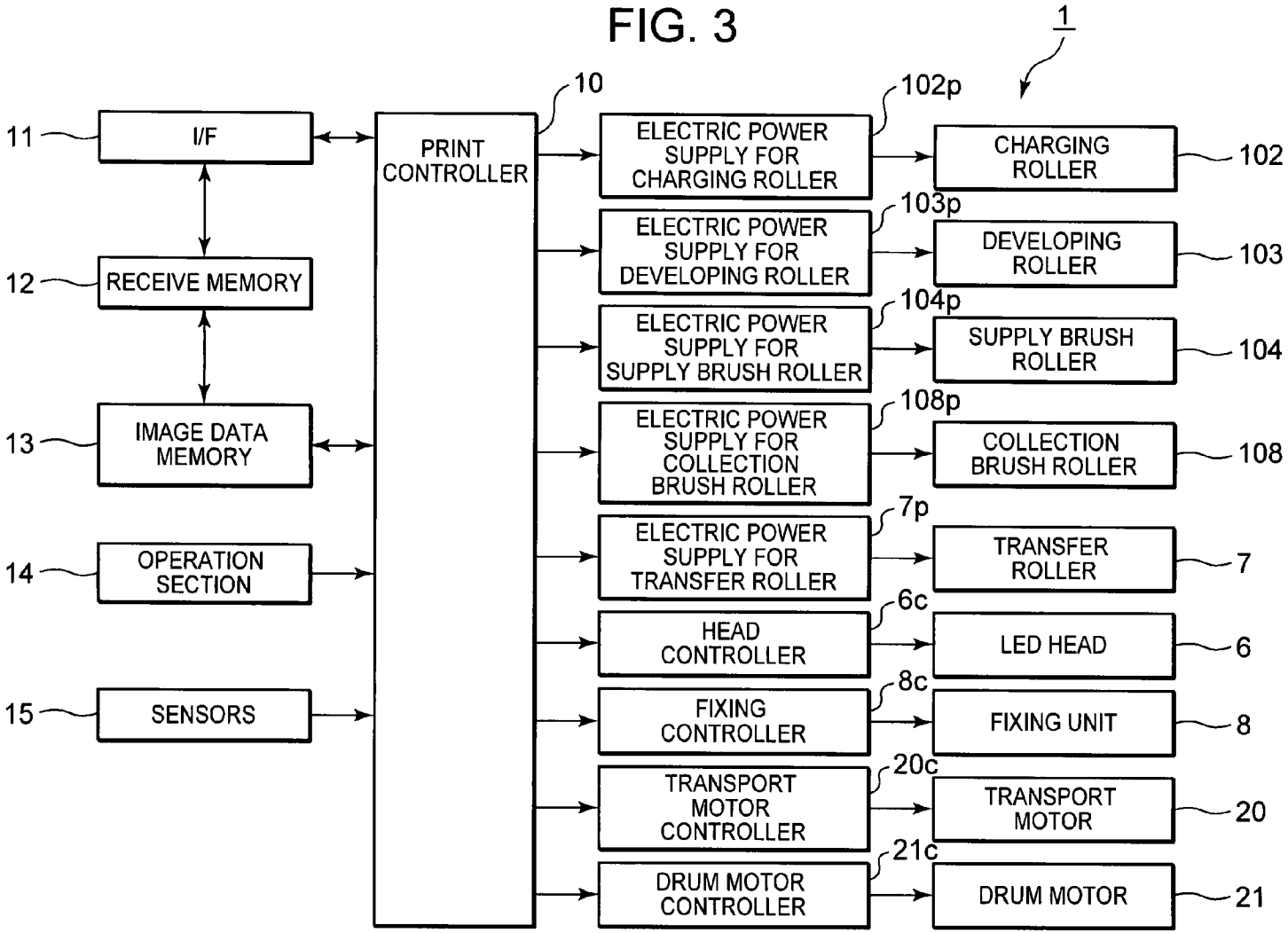
FIG. 3 is a block diagram of the printer of the first embodiment.

Next, a control system of the printer will be described. FIG. 3 is a block diagram of the printer. The printer may include a print controller 10, an interface (I/F) 11, a receive memory 12, an image data memory 13, an operation section 14 and sensors 15. The printer may also include an electric power supply 102*p* for the charging roller 102, an electric power supply 103*p* for the developing roller 103, an electric power supply 104*p* for the supply brush roller 104, an electric power supply 108*p* for the collection brush roller 108 and an electric power supply 7*p* for the transfer roller 7. The printer further may include a head controller 6*c*, a fixing controller 8*c*, a transport motor controller 20*c* and a drum motor controller 21*c*.

The print controller 10 may be composed of a microprocessor, memories such as a ROM (Read Only Memory) and a RAM (Random Access Memory), an input/output (I/O) port and a timer. The print controller receives print data and control commands from a host device, not shown, through the interface 11, and controls the entire printer according to control programs stored in the memories, thereby performing a printing operation. The receive memory 12 temporarily stores the print data received through the interface. The image data memory 13 sequentially stores the print data temporarily stored in the receive memory. The image data memory also stores image data that is generated by the print controller based on the print data. The operation section 14 may include an LED, a switch and a display. The LED notifies a user of the status of the printer. The user can provide instructions to the printer through the switch and the display. The sensors 15 are various sensors, such a medium sensor, a hygrothermal sensor and a print density sensor, to monitor the status of the printer.

The electric power supplies 102*p*, 103*p*, 104*p*, 108*p* and 7*p* respectively apply predetermined voltages to the charging roller 102, the developing roller 103, the supply brush roller 104, the collection brush roller 108 and the transfer roller 7, according to commands from the print controller 10. It should be noted that these electric power supplies can adjust values of the voltages according to the commands from the print controller.

The head controller 6*c* sends the image data stored in the image data memory 13 to the LED head 6 and drives the head. The fixing controller 8*c* applies a voltage to the fixing unit 8 and controls the fixing unit. The fixing unit includes a heater, which is a heat source to fuse the toner image on the medium M, and a temperature sensor, not shown. The fixing controller controls the heater based on an output signal from the temperature sensor so that the temperature of the fixing unit is maintained at a constant fixing temperature.

The transport motor controller 20*c* controls a transport motor 20, which rotates the transport rollers 3, 4 and 5, to transport the medium M. That is to say, the transport motor controller initiates and stops the transportation of the medium with predetermined timing according to commands from the print controller 10. The drum motor controller 21*c* controls a drum motor 21 to rotate the photosensitive drum 101. When the drum motor controller drives the drum motor, the drum rotates in the direction shown in FIG. 2. In conjunction with the rotation of the drum, the charging roller 102, the developing roller 103, the supply brush roller 104, the collection brush roller 108, and the agitators 110, 111, 112, 113 and 114 respectively rotate in the directions shown in FIG. 2 through trains of gears not shown.

Next, the image-forming unit 100 will be described in more detail. Referring to FIG. 2, the toner 115 is nonmagnetic one-component toner, which is negatively chargeable. The toner 115 contains polyester resin as a binder resin and is made by a grinding technique. The toner 115 has a volume average particle size of 5.7 μm, a circularity of 0.92 and an amount of charge, which is measured by the blow-off method, equal to −36 μC/g. The volume average particle size, the circularity and the charge amount are respectively measured with the coulter multisizer 2 (Beckman Coulter, Inc.), the flow particle image analyzer FPIA-3000 (Sysmex Corp.) and the particle charge amount measurement device TYPE TB-203 (KYOCERA Chemical Corp.). In addition, a saturation charge amount of the toner 115 is measured at a blow pressure of 7.0 kPa and a suction pressure of −4.5 kPa, after agitating a mixture of 0.5 g of the toner 115 and 9.5 g of a ferrite carrier (F-60: Powdertech Corp.) for 30 minutes.

Figure 4:
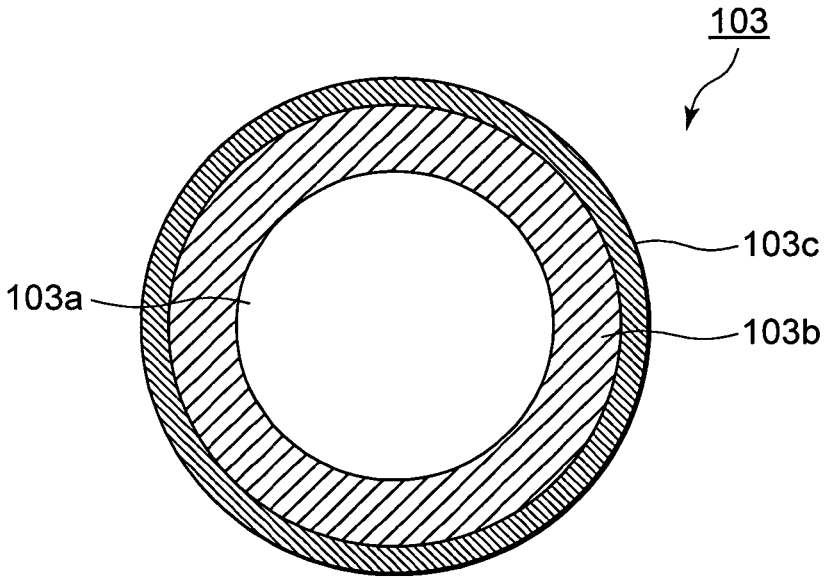
FIG. 4 is a cross-sectional view of a developing roller of the first embodiment.

FIG. 4 is a cross-sectional view of the developing roller 103, which is composed of a conductive shaft 103*a* coated with an elastic layer 103*b*. The elastic layer may be made of a rubber material such as silicone rubber or urethane rubber, and may have a hardness in the range of 50° to 80° (Asker C). In the first embodiment, the elastic layer is made of silicone rubber and has a hardness of 60°. The developing roller also has a semi-conductive resin layer 103*c*, which provides an electric charge to the toner 115, on the elastic layer. The resin layer may be made of acrylic and have carbon black dispersed therein. The surface of the developing roller has a ten-point average roughness Rz, which is defined by JIS (Japanese Industrial Standards) B0601-1994, in the range of 2 μm to 8 μm. The roughness Rz is measured with the surfcorder SEF3500 (Kosaka Laboratory, Ltd.) under conditions where a stylus radius, a stylus pressure and a measuring speed are respectively 2 μm, 0.7 mN and 0.1 mm/s.

The developing roller 103 has a resistance value in the range of $1\times10^6\Omega$ to $1\times10^9\Omega$. The resistance value is measured as follows.

Figure 5B:
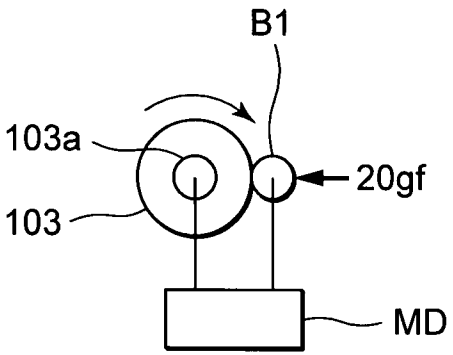
FIG. 5B is a side view of the system for measuring the resistance value of the developing roller of the first embodiment.
Figure 5A:
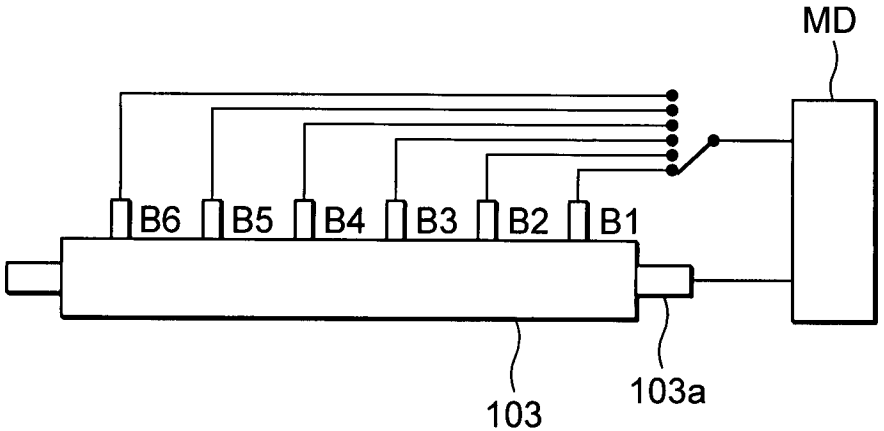
FIG. 5A is a plan view of a system for measuring a resistance value of the developing roller of the first embodiment.

As shown in FIG. 5A, bearings B1, B2, B3, B4, B5 and B6, which are made of stainless steel, are in contact with the surface of the developing roller. Each of the bearings has a width of 2.0 mm and a diameter of 6.0 mm, and is pressed toward the developing roller at a pressure of 20 gf. A measurement device MD used is the high resistance meter HP 4339B (Hewlett-Packard Company).

While rotating the developing roller 103 at a speed of 50 rpm in the direction shown in FIG. 5B, resistance values between the shaft 103*a* and the surface of the developing roller 103 are measured for 100 points along a circumference of the developing roller at the location of the bearing B1. In this measurement, 100 volts are applied to the developing roller. Similarly to the location of the bearing B1, resistance values are measured for 100 points along a circumference of the developing roller at the location of each of bearings B2 to B6. That is to say, 600 resistance values are measured in total. An average value of the 600 resistance values is defined as the resistance value of the developing roller.

Referring back to FIG. 2, the developing blade 106, which is made of stainless steel, has a bent portion at one end, i.e., the developing blade has a cross section that is substantially L-shaped. The developing blade has a thickness of 0.08 mm. The bent portion has a radius of curvature of 0.18 mm and is pressed toward the developing roller 103 at a linear pressure of 35 gf/cm.

Next, the supply brush roller 104 and the brush blade 105 will be described in more detail.

As shown in FIG. 2, the supply brush roller 104 is disposed below the developing roller 103 at a distance therefrom of 0.1 mm to 1.0 mm, and rotates in the same direction.

Figure 6:
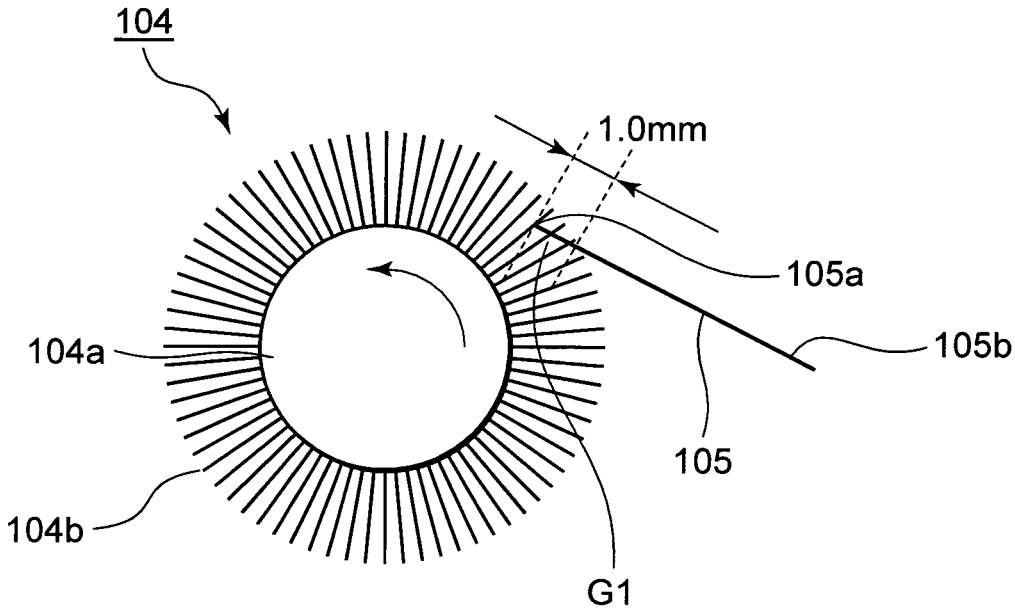
FIG. 6 is a cross-sectional view of a supply brush roller and a brush blade of the first embodiment.

As shown in FIG. 6, the supply brush roller 104 includes a conductive shaft 104*a* and bristles 104*b*. The supply brush roller may be made by wrapping semi-conductive fiber, which has a desired resistance value and has the bristles 104*b* thereon, around the shaft 104*a* in a spiral manner. In the case of using negatively chargeable toner, nylon or acrylic, which is positioned at a more positive side than is the toner 115 in the triboelectric series, is desirable as a material of the fiber in order to negatively charge the toner 115. In the first embodiment, the material is nylon. Each of the bristles (filaments) 104*b* has a length of 3 mm and a fineness of 6 denier. The density of the bristles 104*b* of the supply brush roller is 100 kF/inch$^2$. In addition, the supply brush roller has a resistance value in the range of $1\times10^6\Omega$ to $1\times10^{10}\Omega$. This resistance value is measured with the system shown in FIGS. 5A and 5B by applying 50 volts to the supply brush roller.

The brush blade 105 is in contact with the bristles 104*b*. The brush blade, which is plate-like, is made of metal and has a thickness in the range of 0.1 mm to 1.0 mm. In the first embodiment, the brush blade is made of stainless steel and has a thickness of 0.2 mm. In addition, a contact portion G1 of the brush blade is in contact with the bristles 104*b* so that the direction from a fixed end portion 105*b* toward a free end portion 105*a* of the brush blade is substantially coincident with the rotational direction of the supply brush roller 104. That is to say, the free end portion lies downstream of the fixed end portion in the rotational direction of the supply brush roller. This can prevent a rotational load of the supply brush roller from increasing due to the contact between the supply brush roller and the brush blade. This can also prevent abrasion of the bristles 104*b* caused by that contact.

The amount of contact of the brush blade 105 with the supply brush roller 104 is in the range of 0.5 mm to 1.5 mm. If the amount of contact is less than 0.5 mm, the amount of deflection, i.e., the elastic force, of the bristles 104*b* decreases. On the other hand, if the amount of contact is more than 1.5 mm, the amount of deformation of the bristles 104*b* becomes excessively large. As a result, the toner 115 is trapped between the bristles 104*b* deeply within the supply brush roller. In either case, it is difficult for the supply brush roller to throw the toner 115 toward the developing roller 103. Therefore, in the first embodiment, the amount of contact of the brush blade 105 is adjusted to 1.0 mm, as shown in FIG. 6.

Figures 7A, 7B:
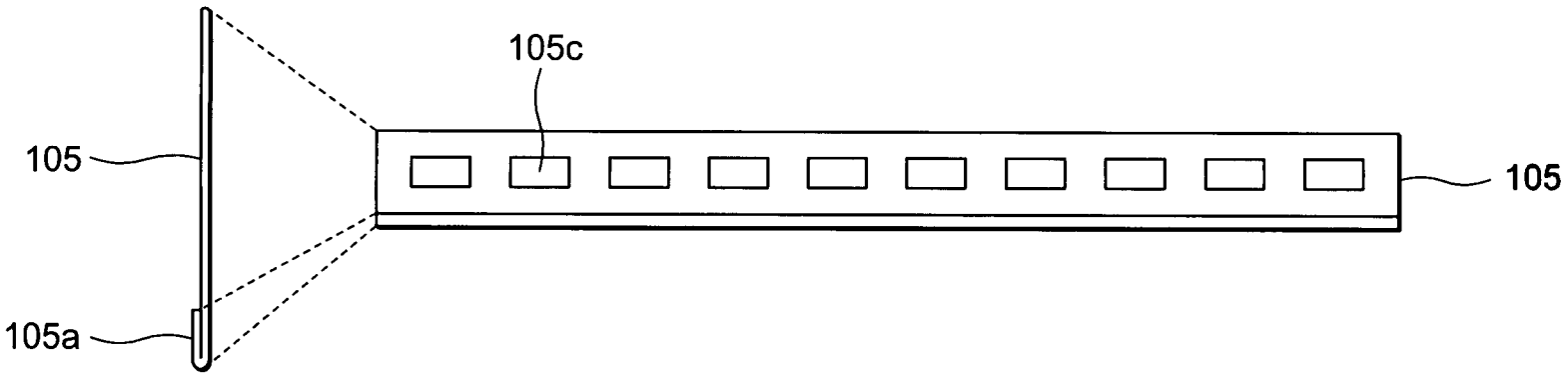
FIG. 7A is a side view of the brush blade of the first embodiment.
FIG. 7B is a plan view of the brush blade of the first embodiment.

As shown in FIG. 7A, the free end portion 105*a* of the brush blade 105, which is brought into contact with the supply brush roller 104, is bent and flattened out, and its tip has a predetermined curvature. Alternatively, the free end portion may be simply bent at a predetermined angle without being flattened out. Moreover, as shown in FIG. 7B, the brush blade has openings 105*c* through which toner scraped off the developing roller 103 by the developing blade 106 passes. The openings 105*c* can prevent the scraped off toner from accumulating on the brush blade and in the vicinity of the contact portion G1.

Figure 8:
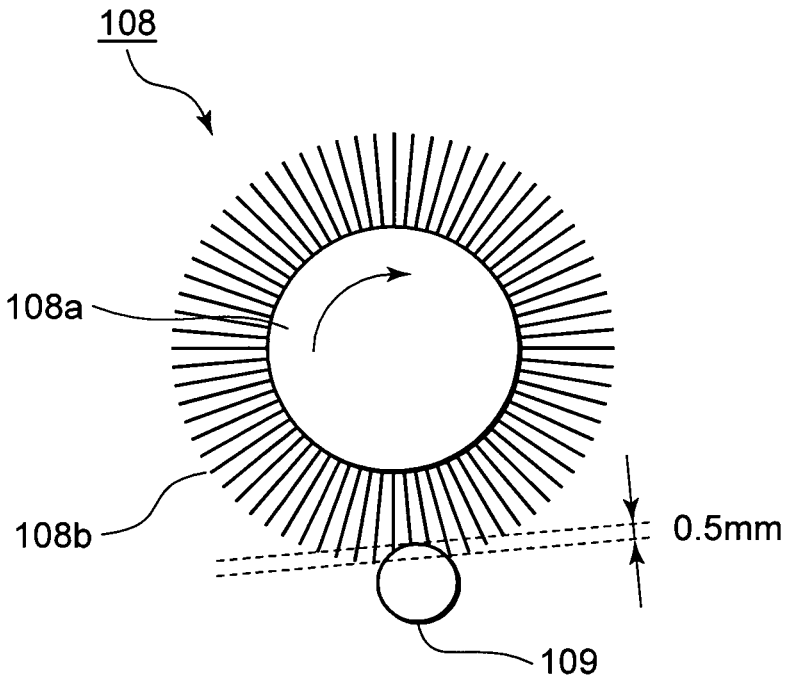
FIG. 8 is a cross-sectional view of a collection brush roller and a flicker of the first embodiment.

Next, the collection brush roller 108 and the flicker 109 will be described in more detail. FIG. 8 is a cross-sectional view of the collection brush roller and the flicker 109.

As shown in FIG. 2, the collection brush roller 108 rotates in an opposite to that of the developing roller 103, while contacting the developing roller. The developing roller and the collection brush roller are disposed so that the developing roller bites 0.5 mm into the collection brush roller. That is to say, the distance between central axes of the developing roller and the collection brush roller is 0.5 mm less than the sum of their radii.

As shown in FIG. 8, the collection brush roller 108 includes a conductive shaft 108*a* and bristles 108*b*. The collection brush roller may be made by wrapping semi-conductive fiber, which has a desired resistance value and has the bristles 108*b* thereon, around the shaft 108*a* in a spiral manner. In the case of using negatively chargeable toner consisting primarily of polyester, Teflon (a registered trade name), which is positioned at a more negative side than is polyester in the triboelectric series, is desirable as a material of the fiber in order to collect the negatively charged toner 115 from the developing roller 103 and neutralize it. Each of the bristles (filaments) 108*b* has a length of 3 mm and a fineness of 6 denier. The density of the bristles 108*b* of the collection brush roller is 75 kF/inch$^2$. In addition, the collection brush roller has a resistance value in the range of $1\times10^6\Omega$ to $1\times10^8\Omega$. This resistance value is measured with the system shown in FIGS. 5A and 5B by applying 50 volts to the collection brush roller. If the resistance value of the collection brush roller is more than $1\times10^8\Omega$, an electric charge accumulates on the bristles 108*b* and thus the collection brush roller is unable to properly neutralize the toner 115.

The flicker 109 is in contact with the bristles 108*b*. The flicker 109, which is columnar, is made of metal and has a diameter of 3 mm. The collection brush roller 108 and the flicker 109 are disposed so that the flicker 109 bites 0.5 mm into the collection brush roller. That is to say, the distance between central axes of the collection brush roller and the flicker 109 is 0.5 mm less than the sum of their radii.

Next, advantages of the first embodiment will be described by comparison with a first comparative example and a second comparative example. Hereinafter, as to a roller, "downstream of a portion" means a semicircular region downstream in the rotational direction of the roller. On the other hand, "upstream of a portion" means a semicircular region upstream in the counter-rotational direction of the roller.

Figure 9A:
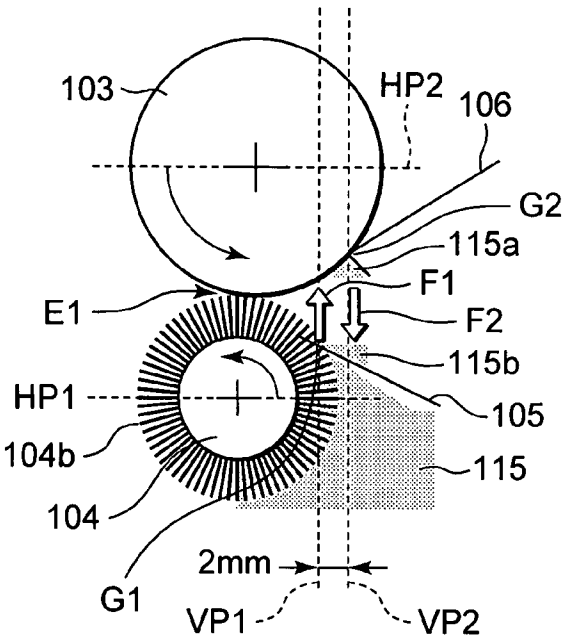
FIG. 9A is a cross-sectional view showing a positional relationship among the developing roller, the supply brush roller, the brush blade and a developing blade of the first embodiment.
Figure 9B:
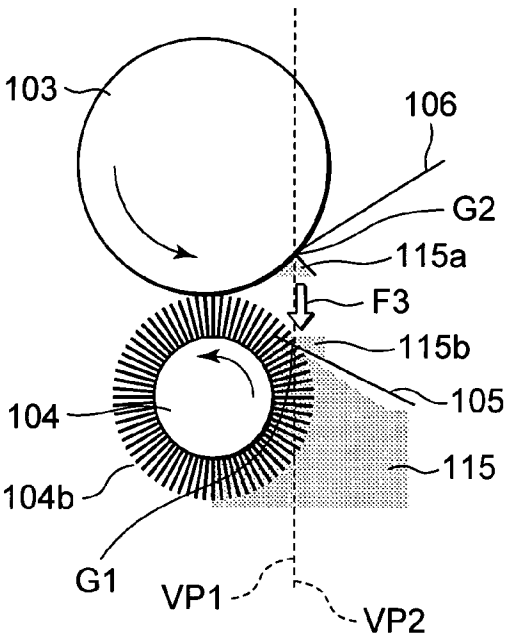
FIG. 9B is a cross-sectional view showing a positional relationship among the developing roller, the supply brush roller, the brush blade and the developing blade of a first comparative example.
Figure 9C:
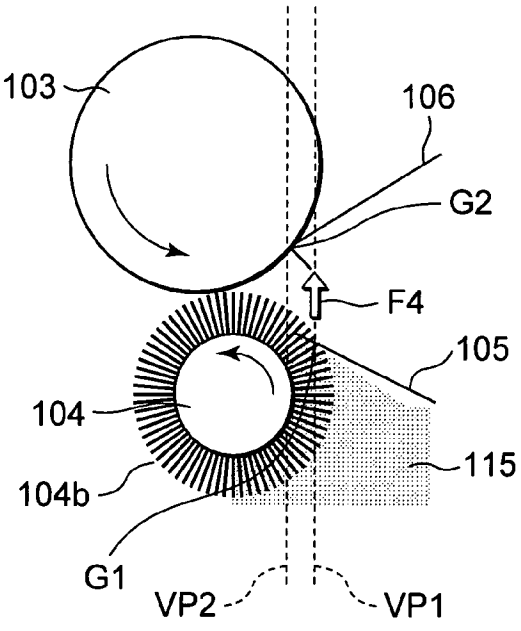
FIG. 9C is a cross-sectional view showing a positional relationship among the developing roller, the supply brush roller, the brush blade and the developing blade of a second comparative example.

FIGS. 9A, 9B and 9C are cross-sectional views showing positional relationships among the developing roller 103, the supply brush roller 104, the brush blade 105 and the developing blade 106, of the first embodiment, the first comparative example and the second comparative example, respectively.

As shown in FIG. 9A, in the first embodiment, the brush blade 105 is in contact with the bristles 104*b* of the supply brush roller 104 above a horizontal plane HP1, which passes through a rotational axis of the supply brush roller, and upstream in the rotational direction of the supply brush roller, of a portion E1 of the supply brush roller opposing the developing roller 103. Meanwhile, the developing blade 106 is in contact with the developing roller below a horizontal plane HP2, which passes through a rotational axis of the developing roller, and downstream in the rotational direction of the developing roller, of the portion E1.

In addition, a vertical plane VP1, which passes through the contact portion G1 of the brush blade 105, lies downstream of a vertical plane VP2, which passes through a contact portion G2 of the developing blade 106 in contact with the developing roller 103, in the rotational direction of the supply brush roller at the portion E1 (lies upstream of the vertical plane VP2 in the rotational direction of the developing roller at the portion E1). That is to say, the vertical plane VP1 is closer to the rotational axis of the supply brush roller than is the vertical plane VP2.

The toner 115 on the bristles 104*b* flies off in the direction of arrow F1 so as to be supplied to the developing roller 103. The thickness of a layer of the toner 115 on the developing roller is adjusted to a predetermined thickness by the developing blade 106. Toner 115*a*, which has not passed between the developing roller and the developing blade, accumulates around the contact portion G2, and then falls to the brush blade 105 in the direction of arrow F2 under its own weight. In the first embodiment, the openings 105*c* (See, e.g., FIG. 7B) of the brush blade are located at an intersection between the brush blade and the vertical plane VP2. Therefore, toner 115*b*, which has fallen from the contact portion G2, falls below the brush blade through the openings and adheres to the bristles 104*b* again. In the first embodiment, the vertical planes VP1 and VP2 are located at a distance from each other of about 2 mm.

As shown in FIG. 9B, in the first comparative example, the vertical planes VP1 and VP2 are coincident with each other. That is to say, the contact portion G1 is located directly below the contact portion G2. The toner 115*a*, which has not passed between the developing roller 103 and the developing blade 106, accumulates around the contact portion G2, and then falls to the brush blade 105 in the direction of arrow F3 under its own weight. The toner 115*b*, which has fallen from the contact portion G2, accumulates on the brush blade, and prevents the toner 115 on the bristles 104*b* from flying off toward the developing roller. Therefore, the toner 115 is not sufficiently supplied to the developing roller, resulting in loss of print quality such as blurring of images.

As shown in FIG. 9C, in the second comparative example, the vertical plane VP1 lies upstream of the vertical plane VP2 in the rotational direction of the supply brush roller 104 at the portion E1 (lies downstream of the vertical plane VP2 in the rotational direction of the developing roller 103 at the portion E1). That is to say, the vertical plane VP1 is farther from the rotational axis of the supply brush roller than is the vertical plane VP2. In this case, the toner 115 is supplied downstream of the contact portion G2 in the rotational direction of the developing roller, as shown by arrow F4. That is to say, the toner 115 is not sufficiently supplied upstream of the contact portion G2 in the rotational direction of the developing roller. This also results in loss of print quality such as the blurring of images.

Next, regarding the image-forming unit 100, an evaluation test of performance for supplying the toner 115 from the supply brush roller 104 to the developing roller 103 will be described. In this test, a solid image printing process, which forms a solid image pattern on the entire printable area of the medium M, and a no-image printing process, which forms no image on the medium, are performed alternately, and the presence or absence of image defects on the solid image pattern is evaluated. Here, the no-image printing process is performed so as to allow more toner 115 to circulate around the supply brush roller. The following nine printing processes are repeatedly performed during the test.

Printing process 1: 5 prints with the solid image pattern
Printing process 2: 100 prints with no image
Printing process 3: 5 prints with the solid image pattern
Printing process 4: 200 prints with no image
Printing process 5: 5 prints with the solid image pattern
Printing process 6: 200 prints with no image
Printing process 7: 5 prints with the solid image pattern
Printing process 8: 500 prints with no image
Printing process 9: 5 prints with the solid image pattern In each of the printing processes 1 to 9, direct voltages of −1000 volts, −200 volts, −600 volts and −100 volts are respectively applied to the charging roller 102, the developing roller 103, the supply brush roller 104 and the collection brush roller 108.

FIG. 10 is a table showing results of the evaluation test. In FIG. 10, a symbol "o" indicates that no image defect occurred on the solid image pattern, and a symbol "x" indicates that blurring of images, i.e., image defects, occurred on the solid image pattern. Each of the results corresponds to an evaluation of the solid image pattern formed on the fifth print in the corresponding solid image printing process.

As shown in FIG. 10, in the configuration of the first embodiment (See, e.g., FIG. 9A), no image defect occurred on the solid image pattern even after a total of 10,000 no-image prints were obtained. In addition, states of accumulation of the toner 115*b* in the vicinity of the contact portion G1 were visually checked after a total of 100, 300, 500, 1,000 and 10,000 no-image prints were obtained. As a result, the accumulation of the toner 115*b*, which prevents the toner 115 on the bristles 104*b* from flying off, was not seen in the vicinity of the contact portion G1.

In the configuration of the first comparative example (See, e.g., FIG. 9B), blurring of images occurred on the solid image pattern after a total of 100 no-image prints were obtained. Besides, upon a visual check the accumulation of the toner 115*b* was seen on the brush blade 105 in the vicinity of the contact portion G1. That is to say, the toner 115*b* on the brush blade prevented the toner 115 on the bristles 104*b* from flying off.

In the configuration of the second comparative example (See, e.g., FIG. 9C), blurring of images already occurred on the solid image pattern before the no-image printing process was performed because the toner 115 was not sufficiently supplied upstream of the contact portion G2 in the rotational direction of the developing roller 103.

In addition, in the first embodiment, the brush blade 105 is in contact with the supply brush roller 104 and flicks the toner 115 off the bristles 104*b*. Therefore, the toner 115 was not trapped between the bristles 104*b* deeply within the supply brush roller 104 even after a total of 20,000 no-image prints were obtained, and the elasticity of the bristles 104*b* was able to be maintained over the long term.

As described above, in the image-forming unit 100 of the first embodiment, the brush blade 105 is in contact with the bristles 104*b* of the supply brush roller 104, which is disposed out of contact with the developing roller 103, and causes the supply brush roller to throw the toner 115 on the bristles 104*b* toward the developing roller. Therefore, the image-forming unit 100 can prevent the toner 115 from being trapped between the bristles 104*b* deeply within the supply brush roller, thereby preventing the elasticity of the bristles 104*b* from decreasing. Thus, the image-forming unit 100 can supply the toner 115 from the supply brush roller to the developing roller in a reliable and steady manner.

Moreover, in the image-forming unit 100, the vertical plane VP1, which passes through the contact portion G1 of the brush blade 105, lies downstream of the vertical plane VP2, which passes through the contact portion G2 of the developing blade 106, in the rotational direction of the supply brush roller at the portion E1 of the supply brush roller opposing the developing roller. Furthermore, the openings 105*c* of the brush blade are located at the intersection between the brush blade and the vertical plane VP2. Therefore, the toner 115*b*, which has fallen from the contact portion G2, does not accumulate on the brush blade in the vicinity of the contact portion G1. Thus, the brush blade can cause the supply brush roller to throw the toner 115 toward the developing roller in a steady and reliable manner.

Second Embodiment

An image-forming unit 200 of the second embodiment has a flicker 205 in place of the brush blade 105 of the image-forming unit 100 of the first embodiment. The other structure of the image-forming unit 200 is similar to that of the image-forming unit 100 of the first embodiment. Therefore, elements similar to those in the first embodiment have been given the same numerals and their description is partially omitted.

Figure 11:
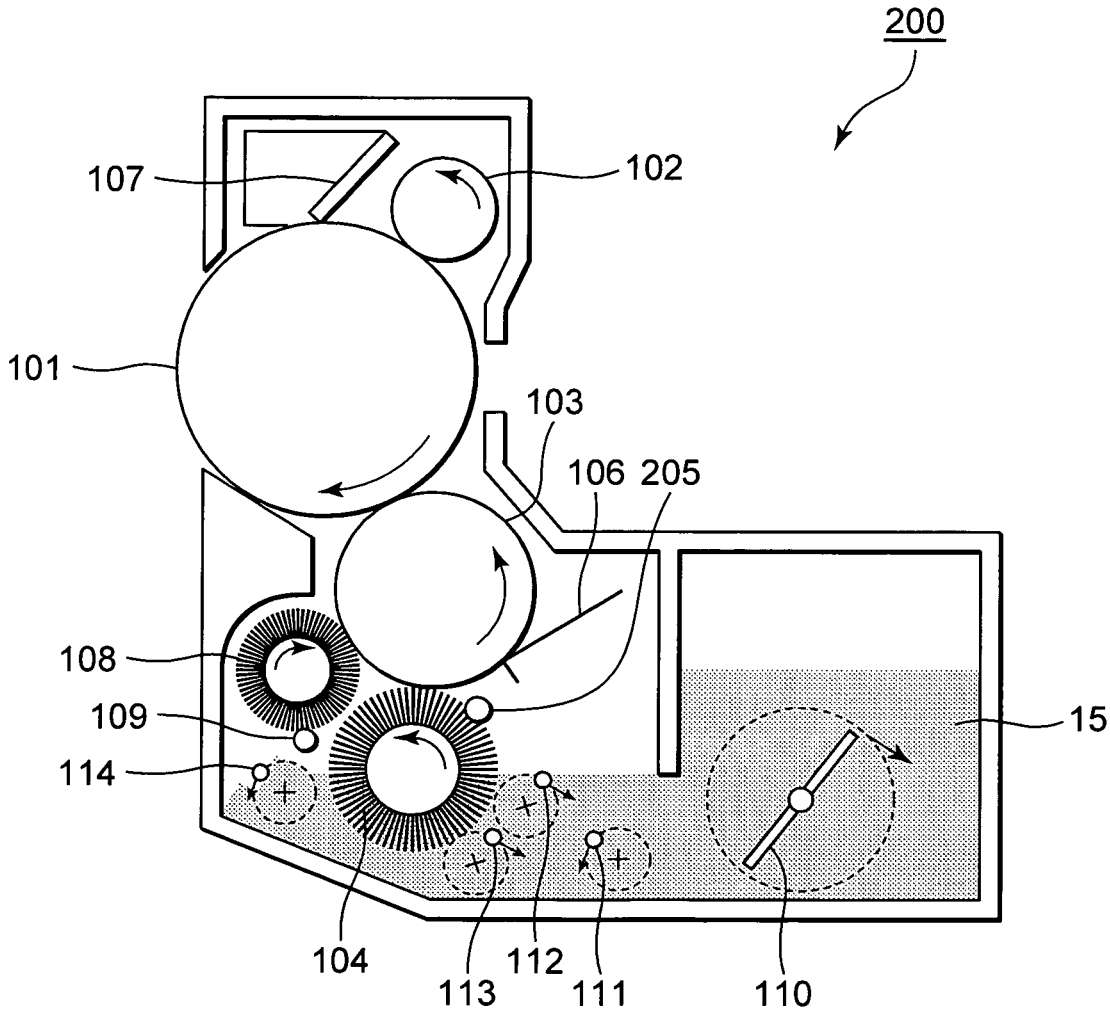
FIG. 11 is a cross-sectional view of an image-forming unit of a second embodiment.
Figure 12:
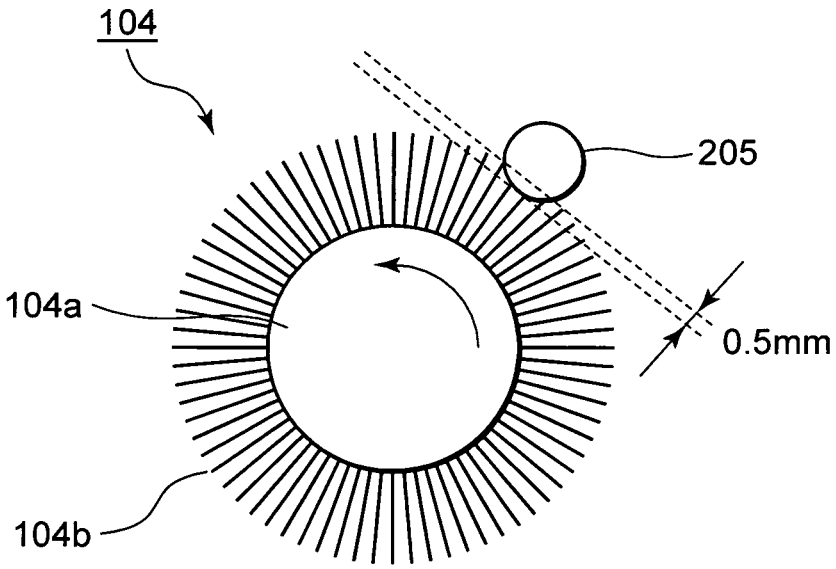
FIG. 12 is a cross-sectional view of the supply brush roller and a flicker of the second embodiment.

FIG. 11 is a cross-sectional view of the image-forming unit 200. FIG. 12 is a cross-sectional view of the supply brush roller 104 and the flicker 205. As shown in FIGS. 11 and 12, the flicker 205 as a brush contact member is in contact with the bristles 104*b* of the supply brush roller 104. The flicker 205, which is columnar, is made of metal and has a diameter of 3 mm. The supply brush roller and the flicker 205 are disposed so that the flicker 205 bites 0.5 mm into the supply brush roller. That is to say, the distance between central axes of the supply brush roller and the flicker 205 is 0.5 mm less than the sum of their radii.

Figure 13:
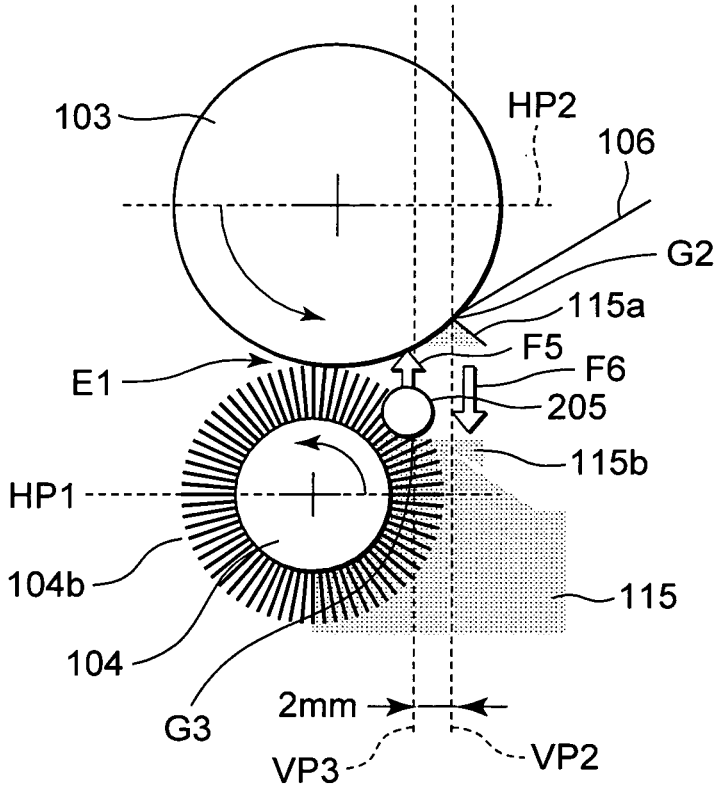
FIG. 13 is a cross-sectional view showing a positional relationship among the developing roller, the supply brush roller, the developing blade and the flicker of the second embodiment.

Next, advantages of the second embodiment will be described. FIG. 13 is a cross-sectional view showing a positional relationship among the developing roller 103, the supply brush roller 104, the developing blade 106 and the flicker 205.

As shown in FIG. 13, in the second embodiment, the flicker 205 is in contact with the bristles 104*b* of the supply brush roller 104 above the horizontal plane HP1, which passes through the rotational axis of the supply brush roller, and upstream in the rotational direction of the supply brush roller, of the portion E1 of the supply brush roller opposing the developing roller 103. Meanwhile, the developing blade 106 is in contact with the developing roller below the horizontal plane HP2, which passes through the rotational axis of the developing roller, and downstream in the rotational direction of the developing roller, of the portion E1.

In addition, a vertical plane VP3, which passes through a contact portion G3 of the flicker 205 in contact with the supply brush roller 104, lies downstream of the vertical plane VP2, which passes through the contact portion G2 of the developing blade 106, in the rotational direction of the supply brush roller at the portion E1 (lies upstream of the vertical plane VP2 in the rotational direction of the developing roller at the portion E1). That is to say, the vertical plane VP3 is closer to the rotational axis of the supply brush roller than is the vertical plane VP2.

The toner 115 on the bristles 104*b* flies off in the direction of arrow F5 so as to be supplied to the developing roller 103. The thickness of a layer of the toner 115 on the developing roller is adjusted to a predetermined thickness by the developing blade 106. The toner 115*a*, which has not passed between the developing roller and the developing blade, accumulates around the contact portion G2, and then falls upstream of the flicker 205 in the rotational direction of the supply brush roller 104 under its own weight, as shown by arrow F6. The toner 115*b*, which has fallen upstream of the flicker 205, adheres to the bristles 104*b* again. In the second embodiment, the vertical planes VP2 and VP3 are located at a distance from each other of about 2 mm.

Next, regarding the image-forming unit 200, an evaluation test of performance for supplying the toner 115 from the supply brush roller 104 to the developing roller 103 will be described. This test is conducted in the same way as that in the first embodiment.

FIG. 14 is a table showing results of the evaluation test. As shown in FIG. 14, in the configuration of the second embodiment (See, e.g., FIG. 13), no image defect occurred on the solid image pattern even after a total of 10,000 no-image prints were obtained. In addition, states of accumulation of the toner 115*b* in the vicinity of the contact portion G3 were visually checked after a total of 100, 300, 500, 1,000 and 10,000 no-image prints were obtained. As a result, the accumulation of the toner 115*b*, which prevents the toner 115 on the bristles 104*b* from flying off, was not seen in the vicinity of the contact portion G3.

In the image-forming unit 100 of the first embodiment, a part of the toner 115*b*, which has fallen from the contact portion G2, might accumulate on the brush blade 105 around the openings 105*c*. In the image-forming unit 200 of the second embodiment, however, since the flicker 205 is columnar, the toner 115*b* does not accumulate on the flicker 205. Therefore, the image-forming unit 200 can reuse the toner 115*b* more effectively.

In addition, in the second embodiment, the flicker 205 is in contact with the supply brush roller 104 and flicks the toner 115 off the bristles 104*b*. Therefore, the toner 115 was not trapped between the bristles 104*b* deeply within the supply brush roller 104 even after a total of 20,000 no-image prints were obtained, and the elasticity of the bristles 104*b* was able to be maintained over the long term.

As described above, in the image-forming unit 200 of the second embodiment, the flicker 205 is in contact with the bristles 104*b* of the supply brush roller 104, which is disposed out of contact with the developing roller 103, and causes the supply brush roller to throw the toner 115 on the bristles 104*b* toward the developing roller. Therefore, the image-forming unit 200 can prevent the toner 115 from being trapped between the bristles 104*b* deeply within the supply brush roller, thereby preventing the elasticity of the bristles 104*b* from decreasing. Thus, the image-forming unit 200 can supply the toner 115 from the supply brush roller to the developing roller in a reliable and steady manner.

Moreover, in the image-forming unit 200, the vertical plane VP3, which passes through the contact portion G3 of the flicker 205, lies downstream of the vertical plane VP2, which passes through the contact portion G2 of the developing blade 106, in the rotational direction of the supply brush roller at the portion E1 of the supply brush roller opposing the developing roller. Therefore, all of the toner 115*a*, which has accumulated around the contact portion G2, falls upstream of the flicker 205 in the rotational direction of the supply brush roller. Thus, the image-forming unit 200 can reuse the toner 115*b*, which has fallen from the contact portion G2, more effectively.

While each of the embodiments has been described with respect to a printer, the invention may be applicable to a multifunction peripheral (MFP), a facsimile machine, or a copier.

The developing device and the image forming apparatus being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A developing device comprising:

a developer bearing body that rotates in a first direction;

a supply brush roller that is disposed below the developer bearing body in opposition to and out of contact with the developer bearing body and rotates in the first direction, the supply brush roller having bristles that supply a developer to the developer bearing body;

a brush contact member that has a first contact portion in contact with the bristles, the first contact portion lying above a first horizontal plane passing through a rotational axis of the supply brush roller, and upstream in the rotational direction of the supply brush roller of a portion thereof opposing the developer bearing body; and a thickness adjusting member that has a second contact portion, wherein the thickness adjusting member is in contact with the developer bearing body only at said second contact portion, and adjusts a thickness of a layer of the developer on the developer bearing body to a predetermined thickness, the second contact portion lying below a second horizontal plane passing through a rotational axis of the developer bearing body, and downstream in the rotational direction of the developer bearing body of the portion of the supply brush roller opposing the developer bearing body, wherein a first vertical plane passing through the first contact portion passes through the developer bearing body upstream in the rotational direction of the developer bearing body of all contact between the second contact portion and the developer bearing body, a second vertical plane passing through a most upstream end on the thickness adjusting member of contact between the thickness adjusting member and the developer bearing body, as measured in the rotational direction of the developer bearing body, is farther from the rotational axis of the supply brush roller than is the first vertical plane, and the brush contact member is plate-like and has an opening at an intersection with the second vertical plane.

2. The developing device according to claim 1, wherein the brush contact member is columnar.

3. The developing device according to claim 1, wherein the developer is nonmagnetic one-component toner.

4. An image forming apparatus comprising the developing device according to claim 1.

5. The developing device according to claim 1, wherein the thickness adjusting member is formed by a plate-like member bent into an L shape in cross section, wherein the second contact portion is the bend in the thickness adjusting member.

6. A developing device comprising:

a developer bearing body that rotates in a first direction;

a supply brush roller that is disposed below the developer bearing body in opposition to and out of contact with the developer bearing body and rotates in the first direction, the supply brush roller having bristles that supply a developer to the developer bearing body;

a brush contact member that has a first contact portion in contact with the bristles, the first contact portion lying above a first horizontal plane passing through a rotational axis of the supply brush roller, and upstream in the rotational direction of the supply brush roller of a portion thereof opposing the developer bearing body; and a thickness adjusting member that has a second contact portion in contact with the developer bearing body and adjusts a thickness of a layer of the developer on the developer bearing body to a predetermined thickness, the second contact portion lying below a second horizontal plane passing through a rotational axis of the developer bearing body, and downstream in the rotational direction of the developer bearing body of the portion of the supply brush roller opposing the developer bearing body, wherein a first vertical plane passing through the first contact portion is closer to the rotational axis of the supply brush roller than is a second vertical plane passing through the second contact portion, and the brush contact member is plate-like and has an opening at an intersection with the second vertical plane.

7. The developing device according to claim 6, wherein the brush contact member is columnar.

8. The developing device according to claim 6, wherein the developer is nonmagnetic one-component toner.

9. An image forming apparatus comprising the developing device according to claim 6.

10. The developing device according to claim 6, wherein the thickness adjusting member is formed by a plate-like member bent into an L shape in cross section, wherein the second contact portion is the bend in the thickness adjusting member.

* * * * *